United States Patent [19]

Cheung

[11] Patent Number: 4,781,142

[45] Date of Patent: Nov. 1, 1988

[54] HIGH PERFORMANCE MARINE ANCHOR

[76] Inventor: Maxwell C. Cheung, 8 Sycamore Creek, Irvine, Calif. 92715

[21] Appl. No.: 16,450

[22] Filed: Feb. 20, 1987

Related U.S. Application Data

[63] Continuation of Ser. No. 736,466, May 21, 1985, abandoned.

[51] Int. Cl.[4] ..... B63B 21/32

[52] U.S. Cl. ..... 114/304; 114/301

[58] Field of Search ..... 114/301-306, 114/294

[56] References Cited

U.S. PATENT DOCUMENTS

| | | | |
|---|---|---|---|
| 16,356 | 1/1857 | Dalton | 114/301 |
| 2,681,631 | 6/1954 | Brewer | 114/301 |
| 2,738,750 | 3/1956 | Voren Kamp | 114/301 |
| 2,743,695 | 5/1956 | Bowman | 114/301 |
| 3,749,044 | 7/1973 | Klaren | 114/301 |
| 3,783,815 | 1/1974 | Towne et al. | 114/208 |
| 4,397,256 | 8/1983 | Bruce | 114/301 |
| 4,459,934 | 7/1984 | Long | 114/304 |

FOREIGN PATENT DOCUMENTS

| | | | |
|---|---|---|---|
| 180391 | 10/1983 | Japan | 114/301 |
| 7608728 | 2/1978 | Netherlands | 114/301 |
| 205146 | of 0000 | United Kingdom | 114/304 |

OTHER PUBLICATIONS

Anchor Manual by R. Van den Haak, Stevshark Anchor by Vryhof Ankers (2 pg. brochure).

Stevpris Anchor by Vryhof Ankers (4 pg. brochure), Great News for Offshore and Dredging: The Uniquely Stabilized Flipper-Delta Anchors brochure.

"Flipper" Delta Anchor, The New Generation Anchor, Anker Advies Bureau B. V. Mooring Anchors by R. C. Towne.

Kiyomoto Anchor by Kiyomoto Iron & Machinery Works Co., Ltd., Vryhof Ankers booklet.

Letter (& enclosure) to M. C. Cheung from Vrijhof Ankers B. V., Krimpen A/D Yssel/The Netherlands, Techdata Sheet Feb. 1983, 83-05, Multiple Stockless Anchors for Navy Fleet Moorings, Techdata Sheet Mar. 1983, 83-09, Stockless and Stato Anchors for Navy Fleet Moorings.

Techdata Sheet, Mar. 1983, 83-08, Drag Embedment Anchors for Navy Moorings.

Navmoor Anchor by MCA Engineers brochure, Bruce International Limited, The Bruce Anchor Mark 2 brochure.

Seabed Reconnaissance and Offshore Soil Mechanics, Gulf Publishing Company, Anchoring Floating Structures, Chapter X, Table of Contents, Introduction, pp. 446-452 (book).

*Primary Examiner*—Sherman D. Basinger
*Assistant Examiner*—Edwin L. Swinehart
*Attorney, Agent, or Firm*—Knobbe, Martens, Olson & Bear

[57] ABSTRACT

The present invention is a drag embedment marine anchor having a fluke and shank which are fixed relative to each other during operation. The fluke is symmetrical about its central longitudinal axis and has two pointed front tips for penetrating soil. The elongated shank extends upwardly along the longitudinal axis of the fluke and is rotatably pinned to a trunion at approximately the geometric center of the fluke, to reduce the bending moment in the shank. The attitude of the shank is fixed relative to the fluke at various attitudes by a stopper, to accommodate different soil conditions. The fluke is wedge-shaped in side elevation, and has stabilizer fins protruding upwardly from a stern transom, the stabilizer fins extending beyond the top surface of the fluke to correct yaw. The fluke is formed from a hollow shell having a smooth top surface and a plurality of stiffening ribs depending from its bottom. The ribs create a frictional drag force which facilitates the intitial penetration of the fluke tips into the sea floor. The fluke is preferably fabricated from welded metal plate, cast metal, reinforced concrete or reinforced concrete lined with metal plate.

29 Claims, 3 Drawing Sheets

HIGH PERFORMANCE MARINE ANCHOR

This application is a continuation of application Ser. No. 736,466, filed May 21, 1985, now abandoned.

BACKGROUND OF THE INVENTION

This invention relates generally to marine anchors, and more particularly to a drag embedment anchor.

Drag embedment anchors are comprised of two major components, a fluke and a shank. Generally, the fluke is relatively flat and has a large surface area, with two pointed front tips which penetrate the soil on the sea floor as the anchor is dragged. When the anchor is completely embedded in the soil on the sea floor, the pressure of the soil on the fluke is a major component of the holding power of the anchor. A typical fluke is formed from a flat plate stiffened by external ribs, or from a wedge-shaped box stiffened by internal ribs.

The shank is generally a long, thin member which is fastened near the stern of the fluke at one end, and to a mooring line at the other end. In most anchors, the shank is coincident with the central longitudinal axis of the fluke when the anchor is viewed from above. The shank serves to transmit forces between the fluke and the mooring line.

There are two broad categories of drag embedment anchors within which most anchors can be classified. The first category includes traditional or swing shank anchors. Traditional anchors have shanks which are straight and rotatably secured to the fluke at a single hinge point so that the shank can pivot to a limited degree on either side of the fluke. As the anchor is dragged along the sea floor, one side of the fluke will face downward, toward the sea floor. Once the fluke tips penetrate the soil, the shank will swing to the other side of the fluke. Since either side of the fluke can be facing downward, the fluke is symmetrical in shape.

The second broad category of anchors includes the modern, or fixed shank type. The flukes of these anchors have a defined top surface and underside since the attitude of the shank is fixed relative to the fluke during operation. The shank extends upwardly from the top surface of the fluke. In order to be able to penetrate the soil, most of these anchors must land on the sea floor with the fluke beneath the shank and with the fluke's bottom side resting on the sea floor.

An important parameter for measuring anchor performance is the holding efficiency, or the ratio of the holding power over the weight of the anchor. Due to the fluke symmetry of the swing shank anchors, extra weight is added to the anchor, thus reducing efficiency. Fixed shank anchors eliminate some of the redundant structure of the traditional anchors.

Anchor designs of both types may be adjusted to accommodate varying soil conditions. The attitude of the shank relative to the fluke should be changed to assist the initial penetration and ultimate depth of the flukes within the soil. The softer the soil is, the wider the "fluke opening angle" should be. However, the means for adjusting the fluke opening angle on previous anchors have suffered from various drawbacks. In swing shank anchors, this angle can be varied by fastening a stopper to the fluke which limits the rotation of the shank past a certain point. However, the stopper is removed when a wide fluke opening angle is desired, and must be stored and handled when not in use. Further, the weight of the stopper reduces efficiency of the anchor when the stopper is in use. Fixed shank anchors such as the "Stevshark", manufactured by Vryhof Ankers, Holland, have shanks which can be fixed at various attitudes without removable parts. However, to adjust the fluke opening angle, the Stevshark requires the laborious fastening and unfastening of a plurality of nuts and bolts which secure the shank to the fluke. Some of the fixed shank anchors do not have any angle adjustment option.

Another problem for both types of anchors is that of initially penetrating the soil as the anchor is being dragged along the sea floor. Previous swing shank anchors have utilized "tripping palms", formed by widening the stern of the fluke to create a V-shaped base on which the anchor rests when the fluke and shank are both in a vertically upright position. As the anchor is pulled by the mooring line, the tripping palms ensure that the fluke will "trip" over and engage the sea floor so that the fluke tips will penetrate the soil, and so the shank will swing open relative to the fluke. While tripping palms have proved successful, their added weight detracts from the anchor's holding efficiency, especially since after the anchor has fully penetrated the soil, the tripping palms serve no further purpose.

Another drawback of previous anchor designs has been their poor control of roll and yaw instability both before and after the anchor has fully penetrated the soil. Yaw is defined as rotation of the anchor about an axis which is normal to the top surface of the fluke, while roll is rotation about the central longitudinal axis of the fluke. Most previous anchors have had their shanks attached near the rear or stern of the fluke, which is far behind the fluke's pressure center. The pressure center is defined as the point on the top surface of the fluke through which the resultant force due to the soil pressure passes. Due to the relative location of the pressure center and the shank attachment point, the shank is effectively pushing the fluke forward, which creates instability.

When the fluke's tips encounter uneven loading, the anchor will yaw. The forces acting on the fluke tips which cause yaw will also cause rolling of the anchor. As the anchor yaws, the shank becomes angled relative to the mooring line. When the yawing force acting on the fluke tips is coupled with a component of the mooring line force on the shank, a roll moment is created.

To stabilize yaw and roll, traditional anchors have been designed with outriggers or stocks, which are elongated tubular bars that protrude outwardly to the sides of the fluke and generally normal to the axis of the shank. While stocks have been helpful in minimizing yaw and roll, their weight reduces the overall efficiency of the anchor.

Thus, there is a need for a drag embedment marine anchor which is lightweight, efficient, adjustable for various soil conditions, easily makes initial penetration, and stabilizes yaw and roll.

SUMMARY OF THE INVENTION

The present invention is comprised of a drag embedment marine anchor having a fluke which is symmetrical about a longitudinal central axis and which has a wedge-shaped exterior when viewed in side elevation. The fluke has pointed front tips to penetrate the soil and a transom which forms a squared-off stern. Extending upwardly from the stern transom and above the top surface of the fluke are a pair of stabilizer fins. When the anchor yaws, the differential in soil pressure on the stabilizer fins creates a restoring moment. The stabilizer fins also provide a drag on the fluke as it proceeds through the soil, which effectively shifts the pressure center behind the geometric center of the fluke.

The present anchor further includes an elongated shank which is secured to the fluke at approximately the geometric center of the fluke. Due to this positioning of the fluke, the bending moment induced in the shank is minimized, thus allowing the use of a lighter shank which improves efficiency.

The fluke is preferably formed from a hollow shell which has a smooth top surface and a plurality of stiffening ribs which depend downwardly from the bottom of the shell. In addition to providing structural reinforcement, the stiffening ribs create a frictional drag force on the bottom of the anchor as the anchor is pulled along the sea floor, which when coupled with the mooring line force creates a moment which rotates the fluke tips into the soil to aid initial penetration.

Preferably, the attitude of the shank relative to the fluke can be adjusted to compensate for varying soil conditions. The shank is rotatably pinned to a trunion at the geometric center of the fluke, and is also pinned to the fluke by a removable stopper so that the shank is maintained in a stationary position during use. By removing the stopper, pivoting the shank about the trunion and pinning the shank to a fluke at a different stopper location, the attitude of the shank can be quickly varied without the use of additional structural components.

To lower the center of gravity of the anchor and to further minimize the bending moment on the shank, the shank preferably curves downwardly towards the fluke, so that the leading edge of the shank forms a convex arc. Preferably, the mid-section of the shank is hollow and is also tapered along the leading edge to form a knife edge. The hollow section of the anchor is preferably reinforced with ribs which are normal to the lengthwise axis of the shank.

The disclosed embodiment of the anchor is configured so that the fluke can be formed from either cast metal, welded metal plate, reinforced concrete, or reinforced concrete which is lined with metal plate.

DETAILED DESCRIPTION OF THE PREFERRED EMBODIMENT

Figure 2:
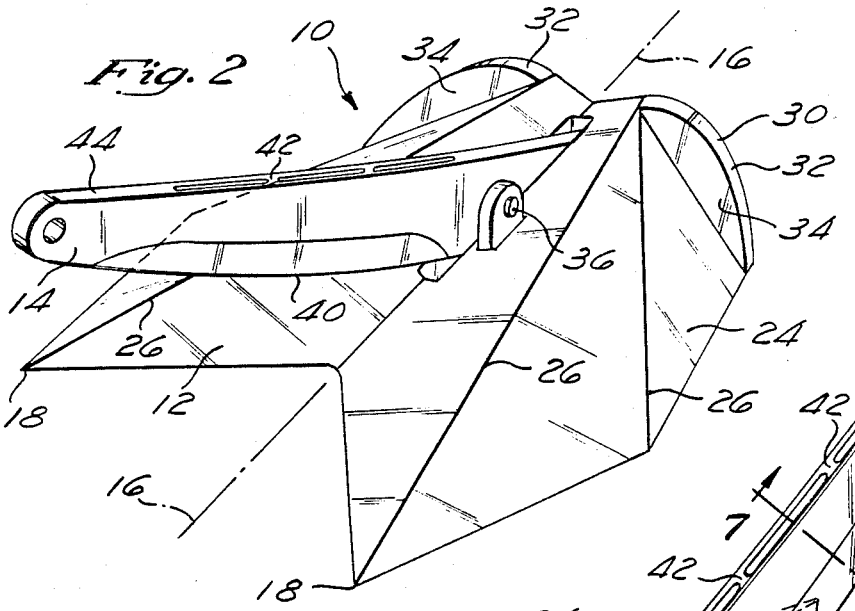
FIG. 2 is a perspective view showing the front of the present anchor.
Figure 1:
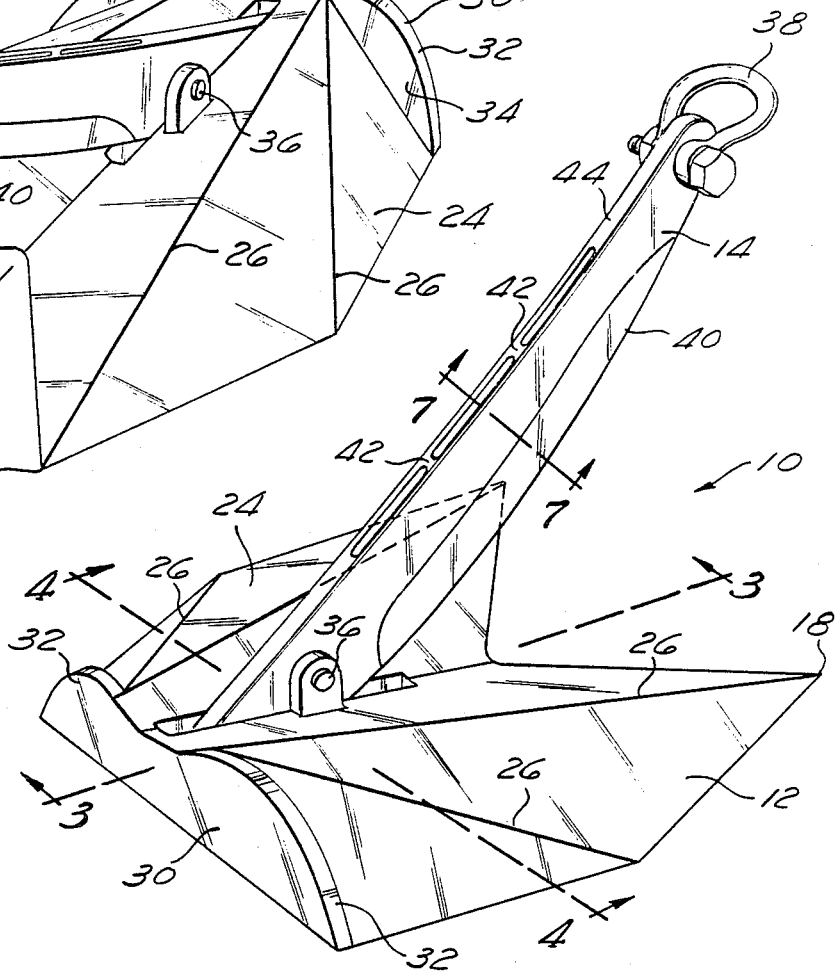
FIG. 1 is a perspective view showing the rear of the present anchor.
Figure 3:
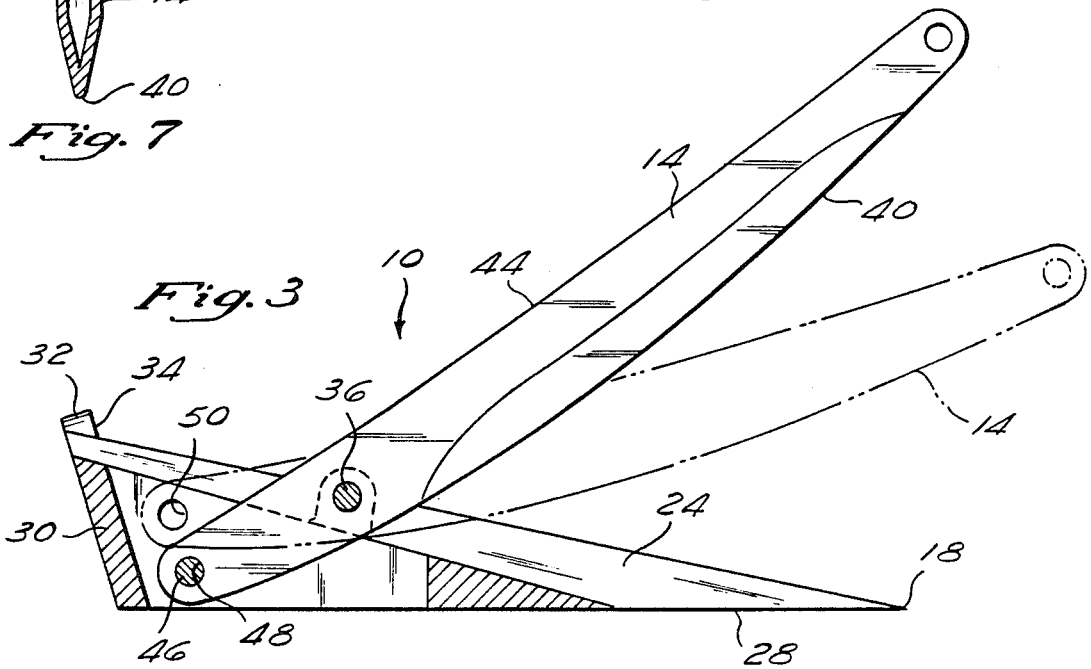
FIG. 3 is a cross-section of the anchor in FIG. 1, taken along line 3—3.
Figure 4:
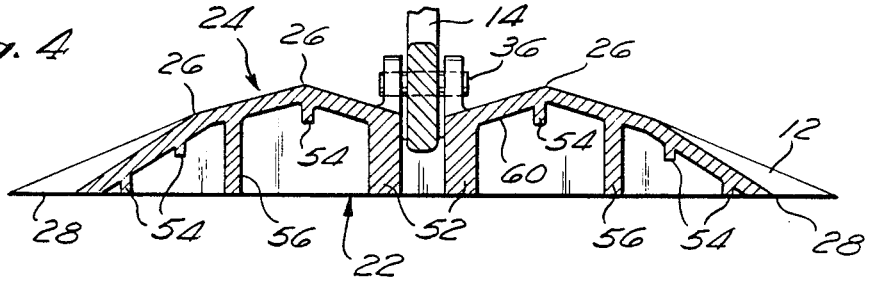
FIG. 4 is a cross-section of the anchor in FIG. 1, taken along line 4—4.
Figure 8:
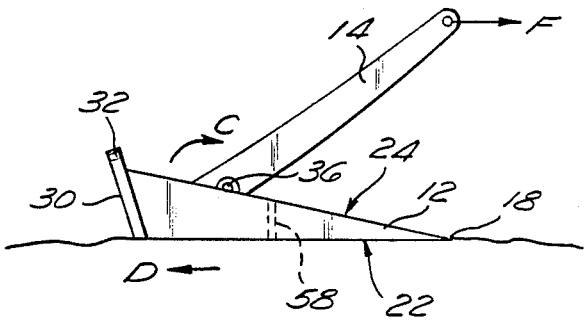
FIG. 8 is a side elevation showing the anchor as it is dragged along the sea floor.

As shown in FIGS. 1 and 2, the present anchor 10 consists of a fluke 12 and a shank 14. The fluke 12 is symmetrical about a central longitudinal axis 16, and has two front tips 18 which are pointed to help penetrate the soil. Referring to FIG. 4, the fluke is preferably formed from a hollow shell 20 which has an unenclosed underside 22 and a top surface 24 which is formed from a plurality of smooth, planar surfaces which intersect along the ridges 26. As best shown in FIGS. 3 and 8, the fluke 12 is wedge-shaped when viewed in side elevation. The top surface 24, a bottom edge 28 (not shown), and a stern transom 30 form the three sides of the wedge shape. The stern or rear end of the shell 20 is enclosed by the stern transom 30, which may be normal to the bottom edge 28, or alternatively, form an obtuse angle with the bottom edge 28.

A pair of stabilizer fins 32 extend upwardly from the stern transom 30, and above the top surface 24 of the fluke 12. As illustrated in FIG. 2, the stabilizer fins 32 each have a front surface 34 with a large surface area which creates a stabilizing drag force on the anchor 10 as the anchor 10 is embedded within the soil, as discussed in more detail below.

The shank 14 is a thin, elongated member which is pinned to the fluke 12 by a trunion 36 which extends above the top surface 24 of the fluke 12. The shank 14 extends upwardly from the fluke 12 along the central longitudinal axis 16 of the fluke 12. At the free end of the shank is a shackle 38, which is used to connect a mooring line (not shown) to the shank.

Figure 7:
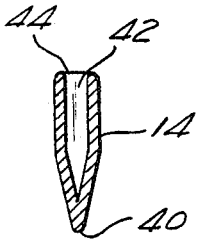
FIG. 7 is a cross-section of the hollow shank on the anchor of FIG. 1, taken along lines 7—7.

Preferably, along the mid-section of the shank, the leading edge 40 of the shank 14 is tapered to form a knife edge, to reduce the resistance of the shank 14 as it advances through soil. The shank 14 also curves downwardly toward the fluke 12 so that the leading edge 40 forms a convex arc. As shown in FIGS. 1 and 7, the shank 14 is preferably hollow along its mid-section and reinforced by structural ribs 42, which are normal to the lengthwise axis of the shank. Between ribs, the hollow portions of the shank are unenclosed along the trailing edge 44 of the shank, so that the shank 14 may be easily formed from cast metal. Due to the hollow construction of the shank 14, unnecessary weight is reduced. The ribs 42 and the hollow construction serve to strengthen the shank 14 so that it may withstand a large side bending moment, such as when the anchor 10 yaws.

Figure 5:
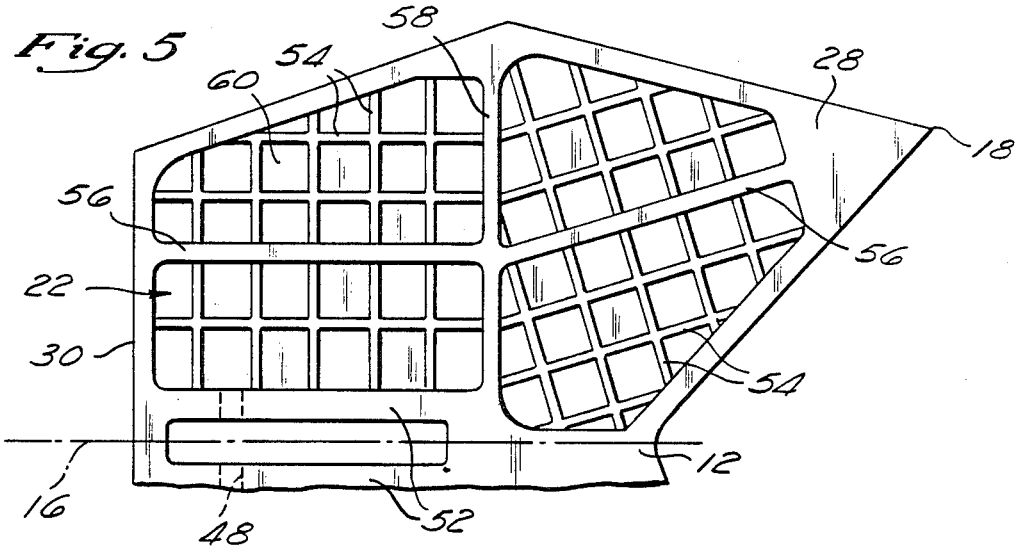
FIG. 5 is a partial plan view of the underside of the present anchor.

As shown in FIG. 3, the shank 14 is rotatable about the trunion 36 so that the attitude of the shank 14 relative to the fluke 12 can be fixed at various positions. To maintain the shank 14 at a stationary position, the tail end of the shank 14 is also pinned to the fluke 12 by a stopper 46. The stopper 46 passes through a hole in the shank as well as through one of several sets of aligned holes 48,50, in a pair of vertical, central ribs 52. As shown in FIGS. 4 and 5, the central ribs 52 form a slot within which the tail end of the shank 14 can rotate. When the shank is pinned to the upper holes 50, the shank 14 (shown in broken lines in FIG. 3) is close to the fluke 12 resulting in a small fluke opening angle, as is desirable for use with hard soils. Alternatively, the shank 14 may be pinned to the lower holes 48, which increases the fluke opening angle to accommodate softer soils. The adjustments to the fluke opening angle are easily made since only the stopper 46, which is easily accessible through the unenclosed underside 22 of the fluke 12, must be relocated. Further, the stopper 46 is an integral part of the anchor 10 regardless of the attitude of the shank 14, and thus does not have to be stored and handled separately.

Referring to FIGS. 4 and 5, a plurality of stiffening ribs 54, 56, and 58 depend vertically downward from the bottom surface 60 of the shell 20. Preferably, the majority of the ribs 54, 56, 58 form a waffle pattern, as illustrated in FIG. 5. The ribs 54, 56, 58 are preferably orthogonal relative to each other, however, a waffle pattern may be formed by the intersection of the ribs at other angular orientations. As shown in FIG. 4, several of the ribs 56, including the central ribs 52 are sufficiently elongated to be flus with the plane formed by the bottom edge 28. Alternatively, any of the ribs 52, 54, 56, 58 may extend below the bottom edge 28.

The ribs 54, 56, 58 provide structural reinforcement so that the fluke shell 20 is stiffened, and so that thinner, lighter plate can be used to form the shell 20. The ribs also facilitate the initial penetration of the fluke tips 18 within the soil. Since only the bottom edge 28 and several of the more elongated ribs 52 and 56 contact the sea floor when the anchor 10 lands, the weight of the anchor 10 will more rapidly cause the anchor 10 to sink within the soil and bury the fluke tips 18, even before the anchor 10 is dragged along the sea floor. Unlike a tripping palm, which serves the same purpose, the unique underside 22 of the present anchor 10 does not provide resistance once the anchor 10 has fully penetrated the soil, since none of the ribs 56 protrude beyond the bottom edge 28.

In operation, the anchor 10 is dropped into the water and falls freely until it lands on the sea floor. The anchor 10 lands on the underside 22 of the fluke 12, in the orientation shown in FIGS. 3 and 8. The anchor 10 is then dragged along the sea floor by the mooring line, which is sufficiently long so that the force F is substantially horizontal in orientation, as shown in FIG. 8.

The ribs create a frictional drag force on the underside 22 of the fluke 12 as the anchor 10 is pulled along the sea floor. As shown in FIG. 8, the force F of the mooring line and the frictional drag force D on the underside 22 of the fluke 12 create a moment C which will cause the anchor 10 to rotate so the fluke tips 18 will quickly begin penetration of the soil. The frictional force D is largely generated by a rib 58 and the stern transom 30 which have large surfaces that are normal to the central longitudinal axis 16 of the fluke 12, which corresponds to the anchor's direction of travel. Alternatively, the ribs 54, 56 and 58 may be replaced by other friction generating surfaces, such as cleats or scoops.

Figure 11:
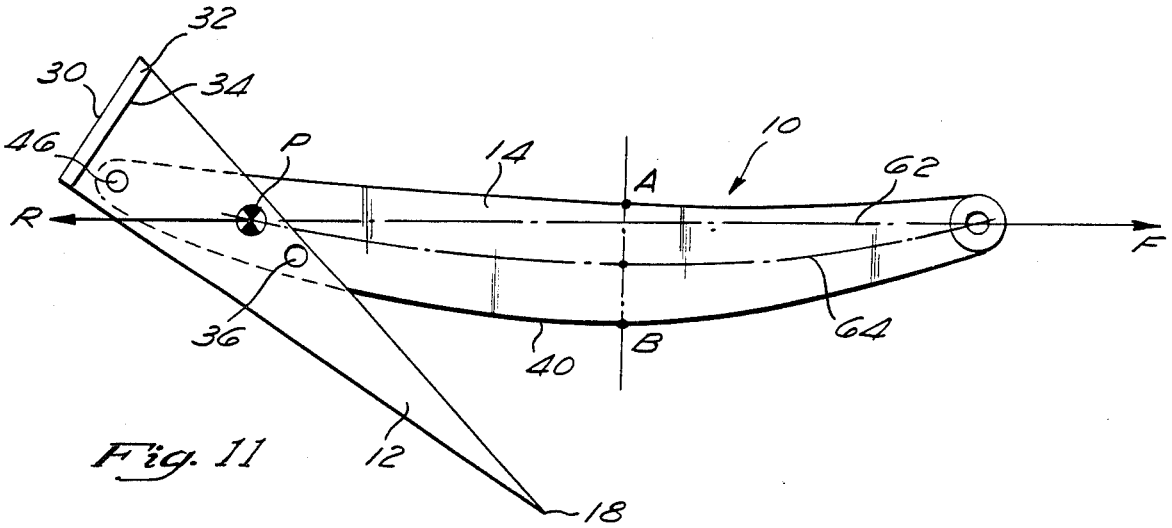
FIG. 11 is a side elevation of the anchor showing the location of external forces on the shank during operation of the anchor.

The trunion 36 is preferably located at approximately the geometric center of the fluke's top surface 24. The geometric center is usually coincident with the pressure center of the fluke, however, as shown in FIG. 11, the overall pressure center P is located behind the trunion 36 (geometric center) on the present anchor 10. This is due to the effect of the soil pressure on the stabilizer fins 32 as the fluke 12 progresses through soil. As a result, the shank 14 is effectively pulling the fluke 12 through the soil, which provides for much greater stability than if the shank attachment point were behind the overall pressure center P, resulting in a pushing of the fluke through the soil.

The fins 32 further stabilize the anchor 10 by creating a restoring moment as the anchor yaws. When the first fluke tip 18 encounters a higher resistance than the second fluke tip 18, the anchor 10 will pivot or yaw about the first fluke tip. As the anchor 10 pivots, the stabilizer fin 32 on the side of the second tip is accelerated into firm, undisturbed soil with the front surface 34 of the fin 32 substantially normal to the direction of motion of the fin 32, which provide increased soil pressure on the fin 32 and a greater drag force. However, the front surface 34 of the fin 32 on the side of the first tip rotates substantially tangentially through soil that has already been agitated and displaced by the anchor 10, and thus the fin 32 is not subjected to any additional soil pressure and does not create any additional drag force. The differential in drag forces on the two fins 32 creates a restoring moment which automatically corrects the yaw of the anchor 10.

By correcting the yaw, the stabilizer fins 32 also help to eliminate roll, which is induced by yaw. As the anchor 10 yaws, the shank 14 becomes angled relative to the mooring line, when viewed from above. As a result, there is a component of the mooring line force F acting at the shackle 38 that is normal to the axis of the shank 14. That force component on the shank 14 is counteracted by force components in the opposite direction, acting at the trunion 36 and at the fluke tip 18 that encountered the yaw-causing obstruction. A moment which induces roll is created by these counteracting force components due to the vertical distance between the shackle 38, and the fluke tip 18. As the stabilizer fins 32 correct yaw, the angle between the mooring line and shank 14 is minimized, which in turn reduces the force components normal to the shank 14, and ultimately results in less roll.

Figure 9:
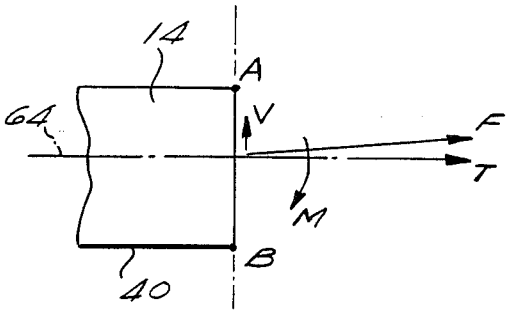
FIG. 9 is a schematic force diagram showing the tensile force and bending moment acting on the shank in FIG. 11.

The anchor 10 is also designed to minimize stress on the shank, which allows the use of a lighter shank 14 and increases overall anchor efficiency. As shown in FIG. 11, once the anchor 10 has fully penetrated the soil, the force F of the mooring line on the shank 14 is counteracted by an equal and opposite force, R. The force R is induced on the shank 14 by the fluke 12, and is the resultant force of the soil pressure on the fluke 12, passing through the overall pressure center P, as discussed above. The line of force 62 between forces F and R passes through the shank 14, and is preferably located above the neutral axis 64 of the shank 14. Due to the distance between the line of force 62 and the neutral axis 64 a bending moment M is induced in the shank 14, the moment M being proportional to the distance between the line of force 62 and the neutral axis 64. FIG. 9 shows both the force F and the moment M acting on the shank 14 at the section taken along line AB, the point at which the distance between the line of force 64 and neutral axis 64 is greatest, resulting in the greatest moment M. The force F is further divided into two orthogonal force components T and V. Force component T is a tension force normal to section AB and force component V is a shear force tangent to section AB.

Figure 10:
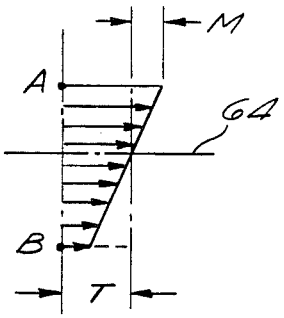
FIG. 10 is a schematic stress distribution diagram of the stress on the shank of FIG. 11.

By translating the force T and moment M into the stress distribution diagram of FIG. 10, it can be seen that the stress on the shank 14 is the least at point B, which is also the thinnest point of the shank 14 due to the knife edge shape of the leading edge 40. This is due to the compressive stress on the shank 14 below the neutral axis 64, caused by the moment M, which offsets the tensile stress of force T. Due to this favorable stress distribution, the amount of material required to fabricate the shank 14 can be greatly reduced, thus decreasing the weight of the anchor 10, and increasing the anchor's efficiency.

This favorable stress distribution is achieved by designing the shank 14 so that it passes through the pressure center P and the geometric center of the fluke. Further, the shank curves downwardly, toward the fluke 12 along its leading edge 40, so that the leading edge 40 forms a convex arc. The curvature of the shank 14 also lowers the center of gravity of the anchor 10, so it is less prone to roll. As a result, the distance between the neutral axis 64 and the line of force 62 is minimized, and thus the stress caused by bending moment M is small relative to that caused by force F. Preferably, the line of force 62 is above the neutral axis 64 so that the moment M is clockwise, or pointing towards the leading edge 40, which will cause a compressive stress on the thinner leading edge 40 to relieve the tension of force F.

In previous fixed shank anchors, the neutral axis has been above the line of force, and separated by a large distance. Thus, the stress on the shank caused by the bending moment is greater than the stress due to the mooring line force, resulting in an overall increase in stress throughout the shank, and, in particular, an increase in the tension along the leading edge of the shank.

Figure 6:
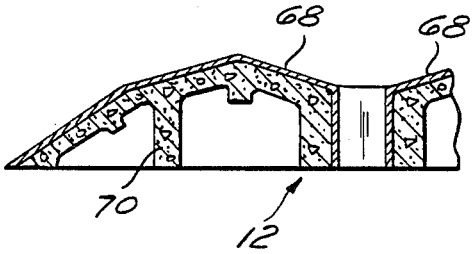
FIG. 6 is a cross-section of the fluke as fabricated from metal plate and reinforced concrete.

The anchor 10 is designed so that it may be fabricated from a large variety of materials and manufacturing methods. In particular, the fluke 12 can easily be manufactured from a cast metal, or be formed by welding metal plates together. For example, the shell 20 can be formed from a plurality of metal plates which are welded together along ridges 26. Alternatively, the entire fluke 12 can be made from reinforced concrete, since the stiffening ribs 54, 56 and 58 will provide sufficient structure to support the shell 20. As shown in FIG. 6, the fluke 12 can be formed from a combination of metal plate 68 and reinforced concrete 70. The metal plate 68 forms a lining into which the concrete 70 can be poured. The use of concrete is particularly advantageous in the fabrication of large-scale anchors, due to the lower cost of concrete relative to metal, the relative ease with which concrete can be formed, and since less corrosion maintenance is required for concrete.

What is claimed is:

1. A drag embedment marine anchor, comprising:

a fluke which is symmetrical about a central longitudinal axis, said fluke having a wedge-shaped exterior when viewed in side elevation and having two pointed front tips for penetrating soil, said fluke having a transom which forms a substantially squared off stern;

a pair of stabilizer fins extending upwardly from said stern transom beyond the top surface of said fluke, said stabilizer fins providing a drag on said fluke as it advances through soil which shifts the pressure center of the fluke behind the geometric center of the fluke, said stabilizer fin also providing a restoring moment on the anchor as it yaws;

an elongated shank extending upwardly from said fluke from a location along said central longitudinal axis, said shank having an arcuate, convex leading edge forming the only curvature between a front end of said shank and a rear end of said shank, the front end of said shank being secured to a mooring chain and the rear end of said shank being secured to the fluke at approximately the geometric center of the fluke so that the bending moment induced in said shank is minimized as the anchor is pulled by the mooring chain through the soil; and said fluke is comprised of a hollow shell having a smooth top surface and a plurality of stiffening ribs depending from the bottom of said shell, said ribs being spaced to define voids therebetween which are adapted to be filled with soil as the anchor sinks into the sea floor, said ribs stiffening the shell and also providing a frictional drag force as the anchor is pulled along the sea floor, to aid the initial penetration of the fluke tips into the soil.

2. The anchor of claim 1, wherein the shank is adjustable to various, fixed attitudes relative to the fluke, to compensate for varying soil conditions.

3. The anchor of claim 2, wherein said shank is rotatably pinned to a fixed trunion located on the fluke, said shank also being pinned to the fluke by a stopper which passes through a hole in the shank and through an aligned hole in the fluke to maintain the shank in a stationary position, the attitude of said shank being adjustable by removing the stopper, pivoting the shank about the trunion and pinning the shank to the fluke through a different hole in the fluke.

4. The anchor of claim 3, wherein said trunion extends above the top surface of the fluke and said stiffening ribs depend vertically downward from said shell, said shank being pinned by said stopper to a pair of ribs which are parallel to said shank and form a slot within which the rear end of the shank pivots.

5. The anchor of claim 1, wherein the leading edge of the shank is tapered to form a knife edge along the mid-section of said shank.

6. The anchor of claim 1, wherein the mid-section of said shank is hollow, and reinforced by ribs which are normal to the longitudinal axis of the shank, said ribs stiffening the shank to withstand increased side bending loads on the shank.

7. The anchor of claim 6, wherein the trailing edge of the shank includes openings which communicate with the hollow portion of the shank.

8. The anchor of claim 1, wherein said fluke is formed from reinforced concrete.

9. The anchor of claim 8, wherein the top surface of said fluke is formed from a metal plate which is lined on the underside with reinforced concrete.

10. The anchor of claim 1, wherein said stern transom and stabilizer fins form an obtuse angle with the bottom edge of the shell.

11. The anchor of claim 1, wherein at least one of said stiffening ribs is substantially normal to the longitudinal axis of the fluke.

12. The anchor of claim 11, wherein the majority of said ribs are orthogonally oriented relative to each other, and form a waffle pattern.

13. A drag embedment marine anchor, comprising:

a fluke comprised of a hollow shell, said shell having a smooth top surface and a bottom edge which surrounds the periphery of the unenclosed underside of said fluke;

an elongated shank secured to the fluke at one end and extending upwardly from said fluke; and a plurality of stiffening ribs depending from the bottom of said shell, said ribs being spaced to define voids therebetween, said voids adapted to be filled with soil as the anchor sinks into the sea floor, at least one of said ribs being oriented substantially normal to the longitudinal axis of said fluke so as to cause friction between the fluke underside and the sea floor as the fluke advances along the sea floor.

14. The anchor of claim 13, wherein the ribs extend no further than the plane of said bottom edge.

15. The anchor of claim 13, wherein said fluke and stiffening ribs are formed from reinforced concrete.

16. The anchor of claim 15, wherein the top surface of said fluke is formed from metal plate which is lined on its underside with reinforced concrete.

17. The anchor of claim 13, wherein said ribs form a waffle pattern on the underside of the fluke.

18. The anchor of claim 17, wherein the majority of said ribs are orthogonally oriented relative to each other.

19. A drag embedment marine anchor, comprising:

a fluke which s symmetrical about a central longitudinal axis;

an elongated shank extending upwardly from said fluke from a location along said axis, said shank having an arcuate, convex leading edge forming the only curvature between one end of said shank which is directly attached to said fluke and another end of said shank which is attached to a mooring line, the curvature of said shank causing the line of force through the shank to be proximate the neutral axis of the shank, so as to reduce stress along the leading edge of said shank.

20. The anchor of claim 19 wherein the pressure center of the fluke is located to the rear of the geometric center of the fluke, and said shank is secured to the fluke so that the shank passes through both the geometric center and pressure center of the fluke.

21. The anchor of claim 19 wherein the line of force through the shank is above the neutral axis of the shank so that a moment is created which reduces the tensile stress on the leading edge of the shank.

22. The anchor of claim 19 wherein the leading edge of said shank is tapered.

23. The anchor of claim 19 wherein the midsection of said shank is hollow, and is reinforced by ribs which are oriented normal to the longitudinal axis of the shank, said ribs stiffening the shank to withstand increased side bending loads on the shank.

24. The anchor of claim 23 wherein a trailing edge of said shank includes openings which communicate with the hollow portion of the shank, so as to permit concrete to be poured into said shank.

25. The anchor of claim 19 wherein said shank is rotatably pinned to a fixed trunion located on the fluke, said shank also being pinned to the fluke in one other location by a single stopper which passes through a hole in the shank and through an aligned hole in the fluke to maintain the shank in a stationary position, the attitude of said shank being adjustable by removing the stopper, pivoting the shank about the trunion, and the pinning the shank to the fluke through a different hole in the fluke.

26. A drag embedment marine anchor, comprising:

a fluke which is symmetrical about a central longitudinal axis;

an elongated shank extending upwardly from said fluke from a location along said axis, said shank having one end which is attached to said fluke and another end which is attached to a mooring line, the midsection of said shank being hollow, and reinforced by at least one rib which is oriented substantially normal to the longitudinal axis of the shank, said rib being substantially planar and abutting the entire periphery of the interior of said hollow midsection so as to form a plurality of separated, independent, hollow compartments, said rib stiffening the shank to withstand increased side bending loads on the shank, the remainder of said shank being solid.

27. The anchor of claim 26 wherein a trailing edge of said shank includes openings which communicate with the hollow compartments of the shank, so as to permit concrete to be poured into said shank and retained within said compartments.

28. The anchor of claim 26 wherein a trailing edge of said shank is provided with elongate openings extending along the length of said hollow compartments, wherein said openings substantially provide the sole access into each of said hollow compartments, so as to permit said shank and rib to be formed together from cast metal without requiring machining of said shank to form said hollow compartments.

29. A drag embedment marine anchor comprising:

a fluke which is symmetrical about a central longitudinal axis;

an elongated shank extending upwardly from said fluke from a location along said axis, said shank having one end which is attached to said fluke and another end which is attached to a mooring line, wherein said shank is substantially solid with the exception of a plurality of hollow compartments formed in the midsection of said shank, said shank including a rib which is integral with the shank, said rib extending across and completely separating said hollow compartments, and wherein a trailing edge of said solid section of said shank is provided with elongate openings along the length of said hollow compartments, wherein said openings provide the sole access into each of said hollow compartments, so as to permit said shank and rib to be formed together from cast metal without requiring machining of said shank to form said hollow compartments.

* * * * *